US005731262A

United States Patent [19]

Ogino et al.

[11] Patent Number: 5,731,262

[45] Date of Patent: Mar. 24, 1998

[54] THERMAL RECORDING MEDIUM

[75] Inventors: Naomi Ogino; Hiroshi Ueda; Sumio Miyake; Yoshimi Midorikawa; Yutaka Wakita, all of Tokyo, Japan

[73] Assignee: Nippon Paper Industries Co., Ltd., Tokyo, Japan

[21] Appl. No.: 725,905

[22] Filed: Oct. 4, 1996

[30] Foreign Application Priority Data

Oct. 5, 1995 [JP] Japan ..... 7-258691

[51] Int. Cl.[6] ..... B41M 5/40

[52] U.S. Cl. ..... 503/207; 503/200; 503/226

[58] Field of Search ..... 427/152; 503/200, 503/207, 226

[56] References Cited

PUBLICATIONS

Claim Translation of Jap. Pat. Publ. No. 45–14039 (1970).

Abstract of Jap. Laid–Open Pat. Publ. No. 62–18626 (1987).

Abstract of Jap. Laid–Open Pat. Publ. No. 61–193883 (1986).

Abstract of Jap. Laid–Open Pat. Publ. No. 62–176879 (1987).

Abstract of Jap. Laid–Open Pat. Publ. No. 62–184880 (1987).

Abstract of Jap. Laid–Open Pat. Publ. No. 6–64324 (1994).

Abstract of Jap. Laid–Open Pat. Publ. No. 7–25147 (1995).

Abstract of Jap. Laid–Open Pat. Publ. No. 7–17131 (1995).

Abstract of Jap. Laid–Open Pat. Publ. No. 6–145645 (1994).

Abstract of Jap. Laid–Open Pat. Publ. No. 8–187942 (1996).

*Primary Examiner*—Bruce H. Hess

*Attorney, Agent, or Firm*—Sherman and Shalloway

[57] ABSTRACT

A thermal recording medium wherein ultraviolet absorbent is included in undercoat layer and/or in thermal sensitive color developing layer, ultraviolet isolator consisted of calcined particle which is flaky pigment whose refractive index is 1.5 to 1.6 and whose surface is coated with insoluble cerium compound and amorphous silica is included in thermal sensitive color developing layer and/or in protective layer, and fluorescent dye is included in protective layer.

11 Claims, No Drawings

THERMAL RECORDING MEDIUM

BACKGROUND OF THE INVENTION

This invention relates to a thermal recording medium which is superior in light resistance, good in appearance of unrecorded portion, and prevented from adherence of depositions and occurrence of sticking.

1. Description of the Prior Art

In general, a thermal recording medium having thermal sensitive color developing layer containing colorless or pale colored dye precursor and developer which develops color by momentary chemical reaction caused by heating with the sensitizer as main components is opened to the public in Japanese Patent Publication 45-14035, and put to practical use widely. Thermal printer having thermal sensitive head and so on are used to obtain records on this thermal recording medium. Thermal recording method as this is used widely for facsimile, field of computer, various measure, label and so on, with the progress of information industly, for features that a noise is not made in recording, developing and fixing are unnecessary, it is free of maintenance, devices are comparatively cheap and compact, and obtained color developing is very clear in comparison with other recording methods put to the public use conventionally.

However, thermal recording medium using this kind of thermal recording material has defects in light resistance of image portions and ground portions. That is, if it is exposed to sun light for long time, the density of image portions is lowered and discolored, the color of ground portions is changed, and those cause damage of impressions.

Thereupon, the method making thermal sensitive color developing layer contain zinc oxide which is inorganic filler having ultraviolet screening effect for the purpose of improvement of light resistance is disclosed in Japanese Patent Laid-open Publication (OPI) 62-18626. However, for inorganic filler having ultraviolet screening effect, although ultraviolet screening effect is large, permeability of visible range is small, color developed portions are hidden, and record density is lowered. Therefore, there is problem that ultraviolet screening effect is lowered and it becomes unuseful if amount of use is decreased enough to keep sufficient record density. And, the method making protective layer contain cerium oxide particles is disclosed in Japanese Patent Laid-open Publication H6-64324. However, it is difficult to regard it suitable as material for thermal recording medium since there is case that cerium oxide itself is colored.

In Japanese Patent Laid-open Publication H7-25147, the method making protective layer contain ultraviolet screener having triple structure whereof kernel particle of inorganic pigment is coated with cerium oxide and the cerium oxide coat surface is coated with inorganic pigment which is the same or different inorganic pigment as said inorganic pigment is disclosed. It is difficult to obtain sufficient light resistance by this since ultraviolet screening effect of cerium oxide is prevented although color of cerium oxide is partially sobered.

On the other hand, the method making protective layer contain benzotriazole-based hydrophobic ultraviolet absorbent is disclosed in Japanese Patent Laid-open Publication 61-193883 for the purpose of improvement of light resistance. However, it has a defect that adherence of depositions and sticking occur during recording in making protective layer contain hydrophobic ultraviolet absorbent. On the other hand, in the case of using soluble ultraviolet absorbent, there is a defect that thermal sensitive head is erosible electrochemically since ions such as sodium salt and so on are formed in becoming soluble of soluble ultraviolet absorbent as disclosed in Japanese Patent Laid-open Publication H7-17131. In Japanese Patent Laid-open Publication 62-176879, benzotriazole compound is made to be contained in undercoat layer and protective layer and even ultraviolet from the back side is absorbed, but this method could not enable to obtain thermal recording medium having sufficient quality too, since ultraviolet absorbent in protective layer caused adherence of depositions and sticking during recording.

And, the method making protective layer contain fluorescent brightener is disclosed in Japanese Patent Laid-open Publication 62-184880, but the effect only by the fluorescent brightener is produced mainly in appearance of unrecorded portion, and it is insufficient to improve light resistance.

2. Object of the Invention

The object of this invention is to provide a thermal recording medium overcoming conventional problems and being superior in light resistance, wherein adherence of depositions and occurrence of sticking is prevented.

BRIEF SUMMARY OF THE INVENTION

The inventors have conducted intensive studies and found that a thermal recording medium achieving the above object can be obtained by containing specific ultraviolet screener as well as ultraviolet absorbent.

That is, this invention relates to a thermal recording medium having undercoat layer, thermal sensitive color developing layer and protective layer laminated in order on a substrate, wherein ultraviolet absorbent is included in undercoat layer and/or in thermal sensitive color developing layer, ultraviolet screener consisted of calcined particle which is flaky pigment whose refractive index is 1.5 to 1.6 and whose surface is coated with insoluble cerium compound and amorphous silica is included in thermal sensitive color developing layer and/or in protective layer, and fluorescent dye is included in protective layer.

DETAILED DESCRIPTION OF THE INVENTION

In the thermal recording medium of this invention, as the ultraviolet absorbent included in undercoat layer or thermal sensitive color developing layer, various well-known absorbent can be used.

The concrete examples of the hydrophobic ultraviolet absorbent can be mentioned as follows, Benzophenone-based ultraviolet absorbent such as
2,4-dihydroxybenzophenone,
2-hydroxy-4-methoxybenzophenone,
2-hydroxy-4-octyloxybenzophenone,
2-hydroxy-4-dodecyloxybenzophenone,
2,2'-dihydroxy-4-methoxybenzophenone,
2,2'-dihydroxy-4,4'-dimethoxybenzophenone,
2-hydroxy-4-methoxy-5-sulfobenzophenone and so on,
benzotriazole-based ultraviolet absorbent such as
2-(2'-hydroxyphenyl)benzotriazole,
2-(2'-hydroxy-5'-methylphenyl)benzotriazole,
22-(2'-hydroxy-5'-tert-butylphenyl)benzotriazole,
2-(2'-hydroxy-3',5'-di-tert-butylphenyl)benzotriazole,
2-(2'-hydroxy-3'-tert-butyl-5'-methylphenyl)-5-chlorobenzo triazole,
2-(2'-hydroxy-3',5'-di-tert-butylphenyl)-5-chlorobenzo triazole,
2-(2'-hydroxy-3,5'-di-tert-aminophenyl)benzotriazole, 2-(2'-hydroxy-3',5'-di-tert-butylphenyl)-5-tert-butylbenzo triazole, 2-(2'-hydroxy-3'-dodecyl-5'-methylphenyl)benzotriazole, 2-[2'-hydroxy-4'-(2"-ethylhexyl)oxyphenyl]benzotriazole, condensation product with methyl-3-[3-tert-butyl-5-(2H-benzotriazole-2-yl)-4-hydroxyphenyl]propionate-polyethyleneglycol (molecular weight is about 300), 5-tert-butyl-3-(5-chloro-2H-benzotriazole-2-yl)-4-hydroxy benzene-propionate octyl, 2,2-methylenebis[4-(1,1,3,3,-tetramethylbutyl)-6-(2H-benzo triazole-2-yl)phenol], 2-(2'-hydroxy-3'-sec-butyl-5'-tert-butylphenyl)-5-tert-butylbenzotriazole and so on, Salicylic acid-based ultraviolet absorbent such as phenylsalicylate, p-tert-butylphenylsalicylate, p-octylphenylsalicylate and so on, Cyanoacrylate-based ultraviolet absorbent such as 2-ethylhexyl-2-cyano-3,3'-diphenylacrylate, ethyl-2-cyano-3,3'-diphenylacrylate and so on, and hindered amine-based ultraviolet absorbent such as bis(2,2,6,6,-tetramethyl-4-piperidyl)sebacate, succinate-bis (2,2,6,6,-tetramethyl-4-piperidyl)ester, 2-(3,5-di-tert-butyl) malonate-bis(1,2,2,6,6,-pentamethyl-4-piperidyl)ester and so on.

The concrete examples of the soluble ultraviolet absorbent can be mentioned as follows, benzophenone-based ultraviolet absorbent such as 2-hydroxy-4-methoxybenzophenone-5-sulfonate, 2-hydroxy-4-methoxybenzophenone-5-sulfonate sodium, 2-hydroxy-4-methoxybenzophenone-5-sulfonate kalium, 2,2'-dihydroxy-4,4'-dimethoxybenzophenone-5-sulfonate sodium, 2,4-dihydroxybenzophenone-5-sulfonate sodium, 2,2'-dihydroxy-4,4'-dimethoxybenzophenone-5,5'-disulfonate sodium, 2,4-dihydroxybenzophenone-5'-sulfonate sodium, 2,2',4,4'-tetrahydroxybenzophenone-5,5'-disulfonate sodium and so on, and benzotriazole-based ultraviolet absorbent such as 2-(2'-hydroxy-4'-methoxy-5'-sulfophenyl)benzotriazole sodium salt, 2-(2'-hydroxy-4'-butoxy-5'-sulfophenyl)benzotriazole sodium salt and so on.

It is not limited to these in this invention, but benzotriazole-based ultraviolet absorbent that is the most effective in light resistance among these is preferably used. And they may be combined with more than two in accordance with requirement. Particularly, in the case of making thermal sensitive color developing layer contain, 2,2-methylenebis[4-(1,1,3,3,-tetramethylbutyl)-6-(2H-benzotriazole-2-yl)phenol] is preferable since coloring is slight and heat resistance of thermal recording medium is favorable.

The amount of ultraviolet absorbent to be used is about 0.1 wt. % to 15 wt. % based on dry mass of undercoat layer or thermal sensitive color developing layer, and more desirably 1 wt. % to 10 wt. % based on dry mass of undercoat layer and 2 wt. % to 10 wt. % based on dry mass of thermal sensitive color developing layer. When the amount of ultraviolet absorbent to be used in undercoat layer or thermal sensitive developing layer is less than 0.1 wt. %, the effect in light resistance is low, and when it is more than 15 wt. %, sensitivity for color developing and image shelf life become low.

In the thermal recording medium of this invention, for ultraviolet screener to be included in thermal sensitive color developing layer or in protective layer, it is desirable to be high in transparency and small in hiding nature in view of color developing density. In the invention, that consisted of calcined particle which is flaky pigment whose refractive index is 1.5 to 1.6 and whose surface is coated with insoluble cerium compound and further with amorphous silica and which has triple structure is used.

Such ultraviolet screener has disclosed in Japanese Patent Laid-open Publication H6-145645 and is well-known. To produce this ultraviolet screener, 1 to 30 wt. % of cerium salt water solution based on pigment as $CeO_2$ is dropped into water dispersion of flaky pigment under heating at first, pH value is adjusted to 7 to 9, and insoluble cerium compound is deposited on the surface of said pigment and formed coated pigment. Secondly, silicate solution is added to water dispersion of this cerium coated pigment under heating, pH value is adjusted to 6 to 8, amorphous silica is deposited and covered on the surface of the said pigment, and it is obtained by calcining at high temperature of more than 200° C. The amount of deposited amorphous silica is 2 to 40 wt. % based on cerium coated pigment as $SiO_2$.

The pigment to be used as kernel is flaky, and desirably about 1.5 to 1.6 of refractive index. As such pigment, mica, talc, sericite, aluminium hydroxide, calcium carbonate, kaoline, calcium hydroxide, aluminium silicate, polyethylene powder, polystyrene, latex and so on can be mentioned. It is desirable since thermal recording medium whose color developing density is favorable can be obtained in using mica, talc, and sericite among them. And, cerium chloride, cerium nitrate, cerium sulfate and so on can be used as cerium compound, and organic silicate can be used as well as inorganic salt such as sodium silicate and so on as silicate.

The amount of ultraviolet screener to be used in protective layer is desirably 5 wt. % to 40 wt. % based on its dry mass. When it is less than 5 wt. %, the effect in light resistance is low, and when it is more than 40 wt. %, barrier nature and sensitivity for color developing of protective layer become lower. It is desirable to contain 10 wt. % to 40 wt. % in thermal sensitive color developing layer based on its dry mass. When it is less than 10 wt. %, the effect in light resistance is low, and when it is more than 40 wt. %, sensitivity for color developing becomes lower.

Furthermore, in the thermal recording medium of this invention, fluorescent dye included in protective layer effects on improvement of light resistance, too. As fluorescent dye, various well-known ones can be used, and derivatives of stilbene, derivatives of coumalin, derivatives of pyrazoline, derivatives of bisstyrylbiphenyl, derivatives of naphthalimide, derivatives of bisbenzooxazolyl and so on can be mentioned, but is not limited to them. Specifically derivatives of diaminostilbene disulfonate is desirably used since its effect in light resistance is high.

The amount of fluorescent dye to be used is desirably 0.01 to 3 wt. % based on dry mass of protective layer, and more desirably 0.1 to 2 wt. %. When the amount of fluorescent dye in protective layer is less than 0.01 wt. %, the effect in light resistance becomes lower, and when it is more than 3 wt. %, coloring of paint of protective layer becomes violent and it leads to fall of ground color of recording medium.

The said ultraviolet screener used in this invention has characteristic triple structure and can keep sufficient brightness. And bad influences such as background fogging desensitization and others are not observed if being contained in thermal sensitive color developing layer, since it is consisted of pigment used genarally in thermal recording medium. Furthermore, it can make thermal recording medium have writing nature in the case of being included in protective layer. And the said ultraviolet screener can be included in undercoat layer.

However, light resistance required in this invention cannot be obtained if thermal recording medium include only the said ultraviolet screener. Probably, it is because cerium compound is coated with amorphous silica and the ultraviolet screening effect of cerium compound is prevented. This invention is characterized including ultraviolet absorbent as well as the said ultraviolet screener and including fluorescent dye, and the thermal recording medium having superior light resistance can be obtained by interaction of these contents. Specifically, in the case of including ultraviolet absorbent in undercoat layer and incruding ultraviolet absorbent and ultraviolet screener in thermal sensitive color developing layer, high light resistance can be obtained and it is effective. In the case of including ultraviolet absorbent and ultraviolet screener in thermal sensitive color developing layer, it is good that ultraviolet absorbent and ultraviolet screener are contained in a ratio of 1:4 to 4:1.

And in this invention, it is considered that including ultraviolet absorbent in undercoat layer or thermal sensitive color developing layer not only absorbs ultraviolet from the reverse side of thermal recording medium but also enlarges ultraviolet absorbability by synergistic effect with ultraviolet screener and fluorescent dye in thermal sensitive color developing layer or protective layer. In the case of including ultraviolet absorbent in protective layer in place of undercoat layer, for example, melting point of benzotriazole-based ultraviolet absorbent is low value such as 120° to 150° C., it melts and causes depositions and so on in heating with thermal sensitive head. Consequently, it is effective means for improvement of light resistance and prevention of adherence of depositions and sticking to contain ultraviolet in undercoat layer or thermal sensitive color developing layer and to include ultraviolet screener in thermal sensitive color developing layer or protective layer as this invention.

To obtain thermal recording medium of this invention, for example, ultraviolet absorbent consisted of benzotriazole compound is dispersed with binder and filler, undercoat layer coating fluid is prepared, coated on a substrate and dried, and undercoat layer is formed. Secondly, dispersion in which each of dye and color developer are dispersed is mixed, necessary additive such as filler and so on are added, thermal sensitive color developing layer coating fluid is prepared, coated and dried on the above undercoat layer, and thermal sensitive color developing layer is formed. Further, protective layer coating fluid including necessary additive such as ultraviolet screener consisted of calcined particle which is flaky pigment whose refractive index is 1.5 to 1.6 and whose surface is coated with insoluble cerium compound and amorphous silica and which has triple structure, fluorescent dye, soluble high molecule, filler and so on are prepared, coated and dried on the above thermal sensitive color developing layer, and protective layer is formed. In this way, thermal recording medium of this invention can be produced.

In the undercoat layer of this invention, emulsion of soluble high molecule or hydrophobic high molecule used generally and so on can be properly used as binder. As concrete example, emulsion of soluble high molecule such as polyvinyl alcohol, polyvinylacetal, hydroxyethyl cellulose, methyl cellulose, carboxymethyl cellulose and so on, starch, its derivatives, polyacrylate soda, polyvinylpyrrolidone, acrylate amide/acrylate ester copolymer, acrylate amide/acrylate ester/methacrylic acid copolymer, styrene/maleic anhydride copolymer alkali salt, isobutylene/maleic anhydride copolymer alkali salt, polyacrylamide, alginate soda, gelatin, casein and so on, and hydrophobic high molecule such as polyvinyl acetate, polyurethane, styrene/butadiene copolymer, polyacrylate, polyacrylate ester, vinyl chloride/vinyl acetate copolymer, polybutyl methacrylate, ethylene/vinyl acetate copolymer, styrene/butadiene/acrylic copolymer, and so on can be used.

As filler in undercoat layer, well-known filler used conventionally and generally, for example, organic filler such as styrene-methacryl copolymer resin, urea-formaldehyde resin, polystyrene, and so on in addition to inorganic filler such as calcium carbonate, silica, zinc oxide, titanium oxide, aluminium hydroxide, magnesium hydroxide, baked kaolin, clay, talc, and so on can be used.

In the protective layer of this invention, various well-known ones can be used as filler. For example of such filler, inorganic pigment such as kaolin, clay, calcium carbonate, baked clay, baked kaolin, aluminium hydroxide, titanium oxide, diatomaceous earth, fine silica anhydride, activated clay, and so on, organic pigment such as styrene microball, nylon powder, polyethylene powder, urea-formaldehyde resin filler, raw starch particle, and so on can be mentioned.

As binder in protective layer, binder consisted of high molecular compound used usually in the field of thermal recording can be used. For example of such binder, starch, hydroxyethyl cellulose, methyl cellulose, carboxymethyl cellulose, gelatin, casein, gum arabic, polyvinyl alcohol, carboxy-denatured polyvinyl alcohol, acetoacetyl group denatured polyvinyl alcohol, silicon denatured polyvinyl alcohol, polyvinyl acetate, vinyl chloride/vinyl acetate copolymer, ethylene/vinyl acetate copolymer, acrylonitrile-butadiene-styrene copolymer, vinyl acetate-acrylic acid copolymer, ethylene/acrylic acid copolymer, styrene/acrylic acid copolymer, acrylate resin, acrylemulsion, diisobutylene/maleic anhydride copolymer, styrene/maleic anhydride copolymer, styrene/butadiene copolymer emulsion, methyl methacrylate/butadiene copolymer, methyl methacrylate-styrene-butadiene copolymer, styrene polymer, isoprene polymer, butadiene polymer, vinyl chloride polymer, vinylidene chloride polymer, urea resin, melamine resin, amide resin, polyurethane resin, and so on can be mentioned.

Further, in protective layer, it is also possible to add properly as occasion demands various auxiliaries, for example, lubricant such as zinc stearate, calcium stearate, polyethylene wax, carnauba wax, parafin wax, ester wax and so on, surface active agent (dispersant, humectant) such as dioctylsulfosuccinate sodium and so on, anti-foaming agent, and soluble multivalent metal salt such as potassium alum, aluminium acetate and so on. And, it is also possible to use together with hardener such as glyoxal, boric acid, dialdehyde starch, epoxy based compound and so on for more improvement of water resistance.

In the thermal recording medium of this invention, as colorless or pale colored dye precursor contained in thermal sensitive color developing layer, various well-known ones can be used, for example, blue color developing dye such as 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-diethylamino-7-dibenzylamino-benzo[a]fluoran and so on, green color developing dye such as 3-(N-ethyl-N-p-tolyl)amino-7-N-methylanilinofluoran, 3-diethylamino-7-anilinofluoran, 3-diethylamino-7-dibenzylaminofluoran and so on, red color developing dye such as 3,6-bis(diethylamino)fluoran-γ-anilinolactam, 3-cyclohexylamino-6-chlorofluoran,
3-diethylamino-7-chlorofluoran,
rhodamine(o-chloroanilino)lactam,
rhodamine(p-chloroanilino)lactam,
3-diethylamino-7,8-benzofluoran,
3-(N-ethyl-p-toluidino)-7-methylfluoran,
3-diethylamino-6,8-dimethylfluoran and so on,
black color developing dye such as
3-(N-ethyl-N-isoamyl)amino-6-methyl-7-anilinofluoran,
3-(N-methyl-N-cyclohexyl)amino-6-methyl-7-anilinofluoran,
3-diethylamino-6-methyl-7-anilinofluoran,
3-di(n-butyl)amino-6-methyl-7-anilinofluoran,
3-di(n-pentyl)amino-6-methyl-7-anilinofluoran,
3-diethylamino-7-(o-chlorophenylamino)fluoran,
3-di(n-butyl)amino-7-(o-chlorophenylamino)fluoran,
3-diethylamino-7-(o-fluorophenylamino)fluoran,
3-di(n-butyl)amino-7-(o-fluorophenylamino)fluoran,
3-(N-ethyl-p-toluidino)-6-methyl-7-anilinofluoran,
3-(N-ethyl-p-toluidino)-6-methyl-7-(p-toluidino)fluoran,
3-diethylamino-6-chloro-7-anilinofluoran,
3-(N-methyl-N-n-propylamino)-6-methyl-7-anilinofluoran,
3-dimethylamino-6-methyl-7-anilinofluoran,
3-dibutylamino-6-methyl-7-m-toluidinofluoran,
3-(N-n-hexyl-N-ethyl)amino-6-methyl-7-anilinofluoran,
3-(N-ethyl-N-isobutyl)amino-6-methyl-7-anilinofluoran,
3-diethylamino-6-methyl-7-p-ethoxyanilinofluoran,
3-pyrrolidino-6-methyl-7-anilinofluoran,
3-piperidino-6-methyl-7-anilinofluoran,
2,2-bis[4-[6'-(N-cyclohexyl-N-mehtylamino)-3'-methylspiro[phthalide-3,9'-xanthene-2'-ylamino]phenyl]propane,
2,4-dimethyl-6-[(4-dimethylamino)anilino]-fluoran,
3-diethylamino-7-(3'-trifluoromethylphenyl)aminofluoran,
3-dipentylamino-7-(3'-trifluoromethylphenyl)anilinofluoran and so on,
and dye having an absorption wavelength in near infrared ranges such as
3,3-bis[1-(4-methoxyphenyl)-1-(4-dimethylaminophenyl)ethylene-2-yl]-4,5,6,7-tetrachlorophthalide,
3,3-bis[1-(4-methoxyphenyl)-1-(4-pyrrolidinophenyl)ethylene-2-yl]-4,5,6,7-tetrachlorophthalide,
3,3-bis[1,1-bis(4-pyrrolidinophenyl)ethylene-2-yl]-4,5,6,7-tetrabromophthalide,
3-p-(p-dimethylaminoanilino)anilino-6-methyl-7-chloro fluoran,
3-p-(p-chloroanilino)anilino-6-methyl-7-chlorofluoran,
3,6-bis(dimethylamino)fluorene-9-spiro-3'-[6'-dimethylamino]phthalide
and others can be mentioned. Of course, it is not limited to these and they may be combined with more than two in accordance with requirement, but 3-di(n-butyl)amino-6-methyl-7-anilinofluoran is preferably used among them for economy such as price and procurement.

And, as color developer used to make dye precursor contained in thermal sensitive color developing layer of this invention colors, for example, well-known color developer can be mentioned as follows. Inorganic acidicsubstance such as activated clay, attapulgite, colloidal silica, aluminium silicate and so on, phenolic compound such as
4,4'-isopropylidenediphenol,
1,1-bis(4-hydroxyphenyl)cyclohexane,
2,2-bis(4-hydroxyphenyl)-4-methylpentane,
4,4'-dihydroxydiphenylsulfide,
hydroquinone monobenzylether, 4-hydroxybenzylbenzoate,
4,4'-dihydroxydiphenylsulfone,
2,4'-dihydroxydiphenylsulfone,
4-hydroxy-4'-isopropoxydiphenylsulfone,
4-hydroxy-4'-n-propoxydiphenylsulfone,
bis(3-allyl-4-hydroxyphenyl)sulfone,
4-hydroxy-4'-methyldiphenylsulfone,
4-hydroxyphenyl-4'-benzyloxyphenylsulfone,
3,4-dihydroxyphenyl-4'-methylphenylsulfone,
bis(4-hydroxyphenylthioethoxy)methane,
1,5-di(4-hydroxyphenylthio)-3-oxapentane,
bis(p-hydroxyphenyl)butylacetate,
bis(p-hydroxyphenyl)methylacetate,
1,1-bis(4-hydroxyphenyl)-1-phenylethane,
1,4-bis[α-methyl-α-(4'-hydroxyphenyl)ethyl]benzene,
1,3-bis[α-methyl-α-(4'-hydroxyphenyl)ethyl]benzene,
di(4-hydroxy-3-methylphenyl)sulfide,
2,2'-thiobis(3-tert-octylphenol),
2,2'-thiobis(4-tert-octylphenol) and so on,
thiourea compound such as
N,N'-di-m-chlorophenylthiourea and so on,
aromatic carboxylic acid such as
p-chlorobenzoate,
4-[2-(p-methoxyphenoxy)ethyloxy]salicylate,
4-[3-(p-tolylsulfonyl)propyloxy]salicylate,
5-[p-(2-p-methoxyphenoxyethoxy)cumyl]salicylate and so on, salt of these aromatic carboxylic acid with multivalent metal such as zinc, magnesium, aluminium, calcium, titanium, manganese, tin, nickel and so on, and organic acidic substance such as antipyrine complex of zinc thiocyanate, compound zinc salt of tetraphthalaldehyde acid with other aromatic carboxylic acid can be mentioned. In the case of using 4-hydroxy-4'-isopropoxydiphenylsulfone and bis(3-allyl-4-hydroxyphenyl)sulfone among them, it is preferable since recording image which is superior in general preservability can be obtained.

The rate of dye precursor and color developer to be used is properly selected in accordance with kind of used dye precursor and color developer and not limited especially, but 1 to 50 parts, preferably about 2 to 10 parts of color developer based on 1 part of dye precursor is used.

And, it is possible to add sensitizer into thermal sensitive color developing layer in accordance with purpose, for example of sensitizer, amide stearate, methoxycarbonyl-N-benzamide stearate, N-benzoylamide stearate, N-amide eicosanoate, ethylenebisamide stearate, amide behenate, methylenebisamide stearate, methylol amide, N-mehtylol amide stearate, dibenzyl terephthalate, dimethyl terephthalate, dioctyl terephthalate, p-benzyloxybenzyl benzoate, 1-hydroxy-2-phenyl naphthoate, oxalic acid dibenzyl, oxalic acid-di-p-methylbenzyl, oxalic acid-di-p-chlorobenzyl, 2-naphthylbenzylether, m-tarphenyl, p-benzylbiphenyl, tolylbiphenylether, di(p-methoxyphenoxyethyl)ether, 1,2-di(3-methylphenoxy)ethane, 1,2-di(4-methylphenoxy)ethane, 1,2-di(4-methoxyphenoxy)ethane, 1,2-di(4-chlorophenoxy) ethane, 1,2-diphenoxyethane, 1-(4-methoxyphenoxy)-2-(2-methylphenoxy)ethane, p-methylthiophenylbenzylether, 1,4-di(phenylthio)butane, p-acetotoluidide, p-acetophenetidide, N-acetoacetyl-p-toluidine, di(β-biphenylethoxy)benzene, p-di(biphenyloxyethoxy)benzene, 1-isopropylphenyl-2-phenylethane and so on are mentioned.

It is possible to combine various pigment in thermal sensitive color developing layer, too. For example, inorganic pigment such as kaolin, clay, calcium carbonate, baked clay, baled kaolin, aluminium hydroxide, titanium oxide, diatomaceous earth, fine silica anhydride, activated clay and so on, and organic pigment such as styrene microball, nylon powder, polyethylene powder, urea-formaldehyde resin filler, raw starch particle and so on can be mentioned.

it is possible to add various auxiliaries into thermal sensitive color developing layer in accordance with requirement, for example, dispersant such as dioctylsulfosuccinate sodium, dodecylbenzenesulfonate sodium, lauryl alcohol sulfuric ester sodium, fatty acid metal salt and so on, wax such as zinc stearate calcium stearate, polyethylene wax, carnauba wax, parafin wax, ester wax and so on, anti-foaming agent, colored dye and so on are properly added.

It is possible to add shelf life improvement agent into thermal sensitive color developing layer, too. As such shelf life improvement agent, examples as follows can be mentioned. Hindered phenol compound such as 2,2'-methylenebis(4-methyl-6-tert-butylphenol),
2,2'-methylenebis(4-ethyl-6-tert-butylphenol),
2,2'-ethylidene bis(4,6-di-tert-butylphenol),
4,4'-thiobis(2-methyl-6-tert-butylphenol),
4,4'-butylidene bis(6-tert-butyl-m-cresol),1-[α-methyl-α-(4'-hydroxyphenyl)ethyl]-4-[α', α'-bis(4"-hydroxyphenyl) ethyl]benzene,
1,1,3-tris(2-methyl-4-hydroxy-5-cyclohexylphenol)butane,
1,1,3-tris(2-methyl-4-hydroxy-5-tert-butylphenyl)butane,
4,4'-thiobis(3-methylphenol),
4,4'-dihydroxy-3,3',5,5'-tetrabromodiphenylsulfone,
4,4'-dihydroxy-3,3'-5,5'-tetramethyldiphenylsulfone,
2,2-bis(4-hydroxy-3,5-dibromophenyl)propane,
2,2-bis(4-hydroxy-3,5-dichlorophenyl)propane,
2,2-bis(4-hydroxy-3,5-dimethylphenyl)propane and so on, epoxy compound such as 1,4-diglycidyloxybenzene, 4,4'-diglycidyloxydiphenylsulfone, 4-benzyloxy-4'-(2-methylglycidyloxy)diphenylsulfone, diglycidyl terephthalate, cresolnovolac type epoxy resin, phenolnovolac type epoxy resin, bisphenol A type epoxy resin and so on, N,N'-di-2-naphthyl-p-phenylenediamine, salt of sodium or multivalent metal with 2,2'-methylenebis (4,6-di-tert-butylphenol)phosphate, bis(4-ethyleneiminocarbonylaminophenyl)methane and so on can be mentioned.

In the thermal recording medium of this invention, method for producing undercoat layer, thermal sensitive color developing layer and protective layer is not limited especially, they are produced by the method wherein coating fluid for recoarding layer is coated and dried on a substrate by suitable coating method, for instance, air knife coating, baribar blade coating, pure blade coating, rod blade coating, short dwell coating,, curtain coating, dry coating and so on, and coating fluid for protective layer is coated and dried on the recording layer. As a substrate, suitable one is selected from paper, plastic film, synthetic paper, non-woven cloth, depositing metal or others and used. The amount of coating fluid for undercoating layer to be coated is about 2 to 12 g/m$^2$, preferably 3 to 10 g/m$^2$ in dry mass, the amount of coating fluid for recording layer to be coated is about 2 to 12 g/m$^2$, preferably 3 to 10g/m$^2$ in dry mass, and the amount of coating fluid for protection layer to be coated is about 0.1 to 20 g/m$^2$, preferably 0.5 to 10 g/m$^2$.

EXAMPLES

The present invention is further illustrated by following Examples. In the Examples and Comparative Examples, the term of "parts" means "parts by weight".

<Producing of ultra violet screener>

500 g of flaky pigment that is a kernel substance of ultra violet screener used in this invention is dispersed to 10L of water, and 264 g of cerium nitrate solution is dropped into it with agitation and heating at 80° C. And, pH value is adjusted to 7 to 9 by aqueous solution of sodium hydroxide, cerium hydroxide is deposited on the pigment surface, then the pigment coated with cerium is obtained by drying and crushing it. Secondly, after dispersing this pigment coated with cerium into 10L of water, 348 g of No. 3 sodium silicate is added with agitation and by heating to more than 80° C., pH value is adjusted to 6 to 8 with sulfuric acid, and the pigment coated with cerium and silica is obtained by drying and crushing it. Further, it is calcinated at 500° C. for 2 hours to obtain the ultra violet screener.

<Producing of thermal recording medium>

Example 1

(1) Forming of an undercoat layer

Solution A (dispersion of ultra violet absorbent 1)

| | |
|---|---|
| 2-(2'-hydroxyphenyl-5'-methylphenyl) benzotriazol | 5 parts |
| 3% polyvinyl alcohol water solution | 1 part |
| water | 20 parts |

Each solution of above-mentioned compound is ground to average particle diameter of 1 μm with a sand grinder. And these dispersion are mixed together by following ratio and the coating fluid is obtained.

| | |
|---|---|
| Solution A | 26 parts |
| 10% polyvinyl alcohol water solution | 150 parts |
| calcinated kaolin (40% dispersion) | 250 parts |

Above-mentioned coating fluid is coated on one surface of 50 g/m$^2$ of substrate in 5.0 g/m$^2$ amount and form an undercoat layer.

(2) Forming of a thermal sensitive color developing layer.

Solution B (dispersion of color developer)

| | |
|---|---|
| 4-hydroxy-4'-isopropoxydiphenylsulfone | 6 parts |
| 10% polyvinyl alcohol water solution | 18.8 parts |
| water | 11.2 parts |

Each solution of above-mentioned compound is ground to average particle diameter of 1 μm with a sand grinder.

Solution C (dispersion of dye)

| | |
|---|---|
| 3-di(n-butyl)amino-6-methyl-7-anilinofluoran | 2.0 parts |
| 10% polyvinyl alcohol water solution | 4.6 parts |
| water | 2.6 parts |

Each solution of above-mentioned compound is ground to average particle diameter of 1 μm with a sand grinder. And these dispersion are mixed together by following ratio and the coating color is obtained.

| | |
|---|---|
| Solution B | 36.0 parts |
| Solution C | 9.2 parts |
| kaolin clay (50% dispersion) | 12.0 parts |

Above-mentioned coating fluid is coated on one surface of 50 g/m$^2$ of substrate in 6.0 g/m$^2$ amount and form an undercoat layer.

(3) Forming of a protective layer

Dispersion are mixed together by following ratio and the coating color is obtained.

| | |
|---|---|
| 10% polyvinyl alcohol water solution | 60.0 parts |
| aluminium hydroxide (50% dispersion) | 30.0 parts |
| zinc stearate | 10.0 parts |
| 30% dispersion of ultra-violet screener (kernel pigment is flaky cericite whose refrective index is 1.556) | 30.0 parts |
| water | 50.0 parts |
| fluorescent dye (diaminostilbene disulfonate derivative; Chinopal ABP liq. Chiba Gaigie) | 0.5 parts |

After each above-mentioned coating color is coated and dried on the recording layer in 4.0 g/m$^2$ of coating amount, processed by a super calender to obtain thermal recording medium (this is an example which includes ultra violet absorbent in an undercoating layer, and includes ultra violet screener and fluorescent dye in a protective layer).

Example 2

In the preparation of a protective layer of Example 1, using a same procedure as disclosed in Example 1 except that the ultra violet screener is replaced with a compound of which kernel pigment is flaky talc having 1.549 refractive index, a thermal recording medium is obtained.

Example 3

In the preparation of a protective layer of Example 1, using a same procedure as disclosed in Example 1 except that the ultra violet screener is replaced with a compound of which kernel pigment is flaky mica having 1.578 reflactive index, a thermal recording medium is obtained.

Example 4

In the preparation of an undercoat layer of Example 1, using a same procedure as disclosed in Example 1 except that solution A is replaced with solution D, a thermal recording medium is obtained.

Solution D (dispersion of ultra violet absorbent 2)

| | |
|---|---|
| 2-(2'-hydroxyphenyl-5'-methylphenyl) benzotriazol | 15 parts |
| 3% polyvinyl alcohol water solution | 3 part |
| water | 60 parts |

Each solution of above-mentioned compound is ground to average particle diameter of 1 μm with a sand grinder. And these dispersion are mixed together by following ratio and the coating color is obtained.

| | |
|---|---|
| Solution D | 78 parts |
| 10% polyvinyl alcohol water solution | 150 parts |
| calcinated kaolin (40% dispersion) | 250 parts |

Example 5

In the preparation of a protective layer of Example 1, using a same procedure as disclosed in Example 1 except altering the amount of ultra violet screener to 60 parts, a thermal recording medium is obtained.

Example 6

In the preparation of a protective layer of Example 1, using a same procedure as disclosed in Example 1 except altering the amount of fluorescent dye 1 part, a thermal recording medium is obtained.

Example 7

In the preparation of a thermal sensitive color developing layer of Example 1, dispersions are mixed together by following ratio and the coating color is obtained.

| | |
|---|---|
| Solution B | 36.0 parts |
| Solution C | 9.2 parts |
| ultra violet screener of Example 1 (30% dispersion) | 13.3 parts |
| kaolin clay (50% dispersion) | 12.0 parts |

In the preparation of a protective layer of Example 1, using a same procedure as disclosed in Example 1 except not mixing the dispersion ultra violet screener, a thermal recording medium is obtained (includes ultra violet absorbent in an undercoating layer, ultra violet screener in thermal sensitive color developing layer and fluorescent dye in a protective layer).

Example 8

In the preparation of a thermal sensitive color developing layer of Example 7,

Solution E (ultra violet absorbent dispersion 3)

| | |
|---|---|
| 22'-methylenebis[4-(1,1,3,3,-tetramethylbutyl) -6-(2H-benzotriazol-2-yl)phenol] | 1.5 parts |
| 10% polyvinyl alcohol water solution | 3.0 parts |
| water | 6.0 parts |

further, except to add 7.8 parts of above-mentioned Solution E, using a same procedure as disclosed in Example 7, a thermal recording medium is obtained (includes ultra violet absorbent in an undercoating layer, ultra violet absorption and screener in thermal sensitive color developing layer and fluorescent dye in a protective layer).

Comparative Example 1

In the preparation of an undercoat layer of Example 1, using a same procedure as disclosed in Example 1 except not using solution A (dispersion of ultra violet absorbent 1) and not using dispersion of ultra violet screener and fluorescent dye, a thermal recording medium is obtained (nothing is included).

Comparative Example 2

In the preparation of an undercoat layer of Example 1, using a same procedure as disclosed in Example 1 except not mixing dispersion of ultra violet screener and fluorescent dye, a thermal recording medium is obtained (just ultra violet absorbent alone is included in an undercoat layer).

Comparative Example 3

In the preparation of an undercoat layer of Example 1, using a same procedure as disclosed in Example 1 except not mixing solution A (dispersion of ultra violet absorbent 1), mixing 7.8 parts of Solution E of Example 8 (ultra violet absorbent dispersion 3) in the preparation of a thermal sensitive color development layer and not mixing dispersion of ultra violet screener and fluorescent dye in the preparation of a protective layer a thermal recording medium is obtained (just ultra violet absorbent alone is included in a thermal sensitive color developing layer).

Comparative Example 4

In the preparation of an undercoat layer of Example 7, using a same procedure as disclosed in Example 7 except not mixing solution A (dispersion of ultra violet absorbent 1), and not mixing fluorescent dye in the preparation of a protective layer a thermal recording medium is obtained (just ultra violet screener alone is included in a thermal sensitive color developing layer).

Comparative Example 5

In the preparation of an undercoat layer of Example 1, using a same procedure as disclosed in Example 1 except not mixing solution A (dispersion of ultra violet absorbent 1), and not mixing fluorescent dye in the preparation of a protective layer a thermal recording medium is obtained (just ultra violet screener alone is included in a protective layer).

Comparative Example 6

In the preparation of an undercoat layer of Example 1, using a same procedure as disclosed in Example 1 except not mixing solution A (dispersion of ultra violet absorbent 1), and not mixing ultra violet screener in the preparation of a protective layer a thermal recording medium is obtained (just fluorescent dye alone is included in a protective layer).

Comparative Example 7

In the preparation of a protective layer of Example 1, using a same procedure as disclosed in Example 1 except not mixing ultra violet screener and mixing 48 parts of dispersion of aluminium hydroxide a thermal recording medium is obtained (ultra violet absorbent is included in an undercoat layer and fluorescent dye is included in a protective layer).

Comparative Example 8

In the preparation of a protective layer of Example 1, using a same procedure as disclosed in Example 1 except not mixing fluorescent dye a thermal recording medium is obtained (ultra violet absorbent is included in an undercoat layer and ultra violet screener is included in a protective layer).

Comparative Example 9

In the preparation of an undercoat layer of Example 1, using a same procedure as disclosed in Example 1 except not mixing solution A (dispersion of ultra violet absorbent 1) a thermal recording medium is obtained (ultra violet absorbent and fluorescent dye is included in a protective layer).

Comparative Example 10

In the preparation of an undercoat layer of Example 1, except mixing 26 parts of Solution A (dispersion of ultra violet absorbent 1) instead of solution of ultra violet screener and 48 parts of dispersion of aluminium hydroxide, a thermal recording medium is obtained (ultra violet absorbent is included in an undercoat layer, and ultra violet absorbent and fluorescent dye is included in a protective layer).

Comparative Example 11

In the preparation of an undercoat layer of Example 1, except mixing dispersion of zinc oxide (30%) instead of solution of ultra violet screener, a thermal recording medium is obtained (ultra violet absorbent is included in an undercoat layer, and zinc oxide and fluorescent dye is included in a protective layer).

Note (1) color developing feature: The density of an image recorded by thermal sensitive facsimile KB-4800 (manufactured by Toshiba) by 18.03 impressive energy and 3. 2 second pulse width is measured by Macbeth densitometer (RD-914 with umber filter).

Note (2) light resistance survival rate; The thermal recording medium printed by the above-mentioned condition is left in a fade-o-meter (BH type manufactured by Toyo Seiki) for 12 hours and the density of printed portion is measured by Macbeth densitometer, and survival rate is culculated by following numerical formula.

$$\text{survival rate} = \frac{Da}{Dn} \times 100\%$$

wherein,

Da=density of image portions after light resistant test

Dn=density of image portions not processed

Note(3) Light resistance ground color ; The thermal recording medium printed in the above-mentioned condition is 12H processed, and the density of not printed portions is measured by Macbeth densitometer (blue filter).

Note(4) Adherence of depositions; Using Panafax UF-60 (manufactured by Panasonic) by copy mode, vertical striped manuscript of B4 is printed and judged visually.

◎ . . . Very small

○ . . . Small

Δ . . . Considerable

Note(5) Sticking; Using Panafax UF-22 (manufactured by Panasonic) by sending mode, printed is judged visually.

◎ . . . Quiet

○ . . . High noise x . . . Sticking pattern appears in the image

Note(6) appearance of unrecorded portion; The whiteness of not printed portions is judged visually.

◎ . . . Pale white

○ . . . White

Δ . . . Yellowish white x . . . Yellowish

TABLE 1

Results of quality performance test

| | color density (Note 1) | light resistance: survival rate (Note 2) | light resistance: ground color (Note 3) | deposition adherence (Note 4) | sticking (Note 5) | appearance of unrecorded portion (Note 6) |
|---|---|---|---|---|---|---|
| Ex. 1 | 1.20 | 93 | 0.09 | ◎ | ◎ | ◎ |
| 2 | 1.18 | 93 | 0.09 | ◎ | ◎ | ◎ |
| 3 | 1.16 | 91 | 0.10 | ◎ | ◎ | ◎ |
| 4 | 1.20 | 91 | 0.08 | ◎ | ◎ | ◎ |
| 5 | 1.15 | 94 | 0.07 | ◎ | ◎ | ◎ |
| 6 | 1.20 | 93 | 0.08 | ◎ | ◎ | ◎ |
| 7 | 1.15 | 89 | 0.10 | ◎ | ◎ | ◎ |
| 8 | 1.18 | 95 | 0.08 | ◎ | ◎ | ◎ |
| Com. Ex. 1 | 1.26 | 65 | 0.21 | ◎ | ◎ | Δ |
| 2 | 1.26 | 67 | 0.19 | ◎ | ◎ | Δ |
| 3 | 1.24 | 77 | 0.16 | ◎ | ◎ | Δ |
| 4 | 1.23 | 75 | 0.18 | ◎ | ◎ | Δ |
| 5 | 1.20 | 83 | 0.15 | ◎ | ◎ | Δ |
| 6 | 1.26 | 65 | 0.20 | ◎ | ◎ | ◎ |
| 7 | 1.26 | 68 | 0.18 | ◎ | ◎ | ◎ |
| 8 | 1.21 | 91 | 0.12 | ◎ | ◎ | Δ |
| 9 | 1.22 | 85 | 0.13 | ◎ | ◎ | ◎ |
| 10 | 1.22 | 90 | 0.09 | X | X | X |
| 11 | 1.14 | 82 | 0.17 | ○ | ○ | Δ |

It is clearly understood from Table 1 that good quality thermal recording medium having high light resistance, prevention of deposition adherence and sticking, and good appearance of unrecorded portion is obtained in Examples 1 to 8 of this invention. On the other hand, light resistance is low in Comparative Examples 1 to 6 wherein ultraviolet absorbent, ultraviolet screener and fluorescent dye are not contained or one of them is singly contained.

In comparative Example 7 wherein aluminium hydroxide is used in spite of ultraviolet screener, light resistance is very bad. Further, not only appearance of unrecorded portion but also light resistance is inferior in comparison with Example 1, in Comparative Example 8 lacking fluorescent dye in protective layer, and Comparative Example 9 lacking ultraviolet absorbent in undercoat layer is inferior in light resistance, too. On the other hand, in Comparative Example 10 wherein ultraviolet absorbent is contained in protective layer in spite of ultraviolet screener, deposition adherence and sticking occur conspicuously and appearance of unrecorded portion is inferior, too. And, in Comparative Example 11 wherein zinc oxide is combined in spite of ultraviolet screener, light resistance and appearance of unrecorded portion is inferior and deposition adherence and sticking occur.

Therefore, thermal recording medium having objective ability cannot be obtained if any one of condition of this invention is lacked.

As mentioned above, excellent thermal recording medium wherein light resistance is improved, discoloring and yellowing of ground portions by light do not occur, and fall of record density and aggravation of appearance by containing ultraviolet absorbent, ultraviolet screener and fluorescent dye simultaneously. And, in the thermal recording medium of this invention, recording with thermal sensitive head can be performed smoothly since deposition adherence and sticking are prevented, and that is very useful.

We claim:

1. A thermal recording medium having an undercoat layer, a thermally sensitive color developing layer and a protective layer laminated in order on a substrate, wherein a) an ultraviolet absorbent is included in said undercoat layer and/or in said thermally sensitive color developing layer, b) an ultraviolet screener is included in said thermally sensitive color developing layer and/or in said protective layer, said ultraviolet screener consisting of calcined particles which are flaky pigments whose refractive index is 1.5 to 1.6 and whose surface is coated with an insoluble cerium compound and an amorphous silica, and c) a fluorescent dye is included in said protective layer.

2. A thermal recording medium having an undercoat layer, a thermally sensitive color developing layer and a protective layer laminated in order on a substrate, wherein a) an ultraviolet absorbent is included in said undercoat layer and said thermally sensitive color developing layer, b) an ultraviolet screener is contained in said thermally sensitive color developing layer, said ultraviolet screener consisting of calcined particles which are flaky pigments whose refractive index is 1.5 to 1.6 and whose surface is coated with an insoluble cerium compound and an amorphous silica, and c) a fluorescent dye is included in said protective layer.

3. The thermal recording medium of claim 1 or 2, wherein said ultraviolet absorbent included in said undercoat layer and/or said thermally sensitive color developing layer is a benzotriazole compound.

4. The thermal recording medium of claim 3, wherein the amount of said ultraviolet absorbent included in said undercoat layer and/or in said thermally sensitive color developing layer is 0.1 wt. % to 15 wt. % based on the dry mass of said undercoat layer and 0.1 wt. % to 15 wt. % based on the dry mass of said thermally sensitive color developing layer.

5. The thermal recording medium of claim 3, wherein the amount of said ultraviolet screener included in said thermally sensitive color developing layer and/or in said protective layer is 10 wt. % to 40 wt. % based on the dry mass of said thermally sensitive color developing layer and 5 wt. % to 40 wt. % based on the dry mass of said protective layer.

6. The thermal recording medium of claim 3, wherein the amount of said fluorescent dye included in said protective layer is 0.01 wt. % to 3 wt. % based on the dry mass of said protective layer.

7. The thermal recording medium of claim 1 or 2, wherein the amount of said ultraviolet absorbent included in said undercoat layer and/or in said thermally sensitive color developing layer is 0.1 wt. % to 15 wt. % based on the dry mass of said undercoat layer and 0.1 wt. % to 15 wt. % based on the dry mass of said thermally sensitive color developing layer.

8. The thermal recording medium of claim 7, wherein the amount of said ultraviolet screener included in said thermally sensitive color developing layer and/or in said protective layer is 10 wt. % to 40 wt. % based on the dry mass of said thermally sensitive color developing layer and 5 wt. % to 40 wt. % based on the dry mass of said protective layer.

9. The thermal recording medium of claim 7, wherein the amount of said fluorescent dye included in said protective layer is 0.01 wt. % to 3 wt. % based on the dry mass of said protective layer.

10. The thermal recording medium of claim 1 or 2, wherein the amount of said ultraviolet screener included in said thermally sensitive color developing layer and/or in said protective layer is 10 wt. % to 40 wt. % based on the dry mass of said thermally sensitive color developing layer and 5 wt. % to 40 wt. % based on the dry mass of said protective layer.

11. The thermal recording medium of claim 1 or 2, wherein the amount of said fluorescent dye included in said protective layer is 0.01 wt. % to 3 wt. % based on the dry mass of said protective layer.

* * * * *